US006740097B1

(12) United States Patent
Sanchez-Martinez

(10) Patent No.: US 6,740,097 B1
(45) Date of Patent: May 25, 2004

(54) EPILATION DEVICE

(75) Inventor: Pedro Sanchez-Martinez, Kronberg (DE)

(73) Assignee: Braun GmbH (DE)

( * ) Notice: Subject to any disclaimer, the term of this patent is extended or adjusted under 35 U.S.C. 154(b) by 11 days.

(21) Appl. No.: 10/018,835

(22) PCT Filed: Jul. 1, 2000

(86) PCT No.: PCT/EP00/06146

§ 371 (c)(1),
(2), (4) Date: Dec. 19, 2001

(87) PCT Pub. No.: WO01/05267

PCT Pub. Date: Jan. 25, 2001

(30) Foreign Application Priority Data

Jul. 16, 1999 (DE) ..... 199 32 884

(51) Int. Cl.[7] ..... A61B 17/50
(52) U.S. Cl. ..... 606/133
(58) Field of Search ..... 606/133, 36, 43

(56) References Cited

U.S. PATENT DOCUMENTS 5,356,415 A * 10/1994 Iwasaki et al. ..... 606/133
5,507,753 A * 4/1996 Iwasaki et al. ..... 606/133
5,810,843 A * 9/1998 Iwasaki et al. ..... 606/133
5,893,854 A * 4/1999 Bontoux et al. ..... 606/133
5,916,222 A * 6/1999 Iwasaki et al. ..... 606/133
6,004,331 A * 12/1999 Takeuchi et al. ..... 606/133
6,176,862 B1 * 1/2001 Delay et al. ..... 606/133
6,520,970 B1 * 2/2003 Sanchez-Martinez ..... 606/133

FOREIGN PATENT DOCUMENTS

EP 0 493 849 A 7/1992
EP 0760219 A1 * 3/1997 ..... 606/133
WO WO 97/19613 A 6/1997

* cited by examiner

*Primary Examiner*—Eduardo C. Robert
(74) *Attorney, Agent, or Firm*—Fish & Richardson P.C.

(57) ABSTRACT

An epilator for plucking hairs from human skin, the epilator having a housing in which an epilating head driven by drive elements and carrying plucking elements is mounted, provision being made in the area of the epilating head for movably mounted driven elements for the mechanical stimulating striking of the skin by a contact element, the striking reducing the subjective pain of epilation to the user.

21 Claims, 5 Drawing Sheets

Fig. 3
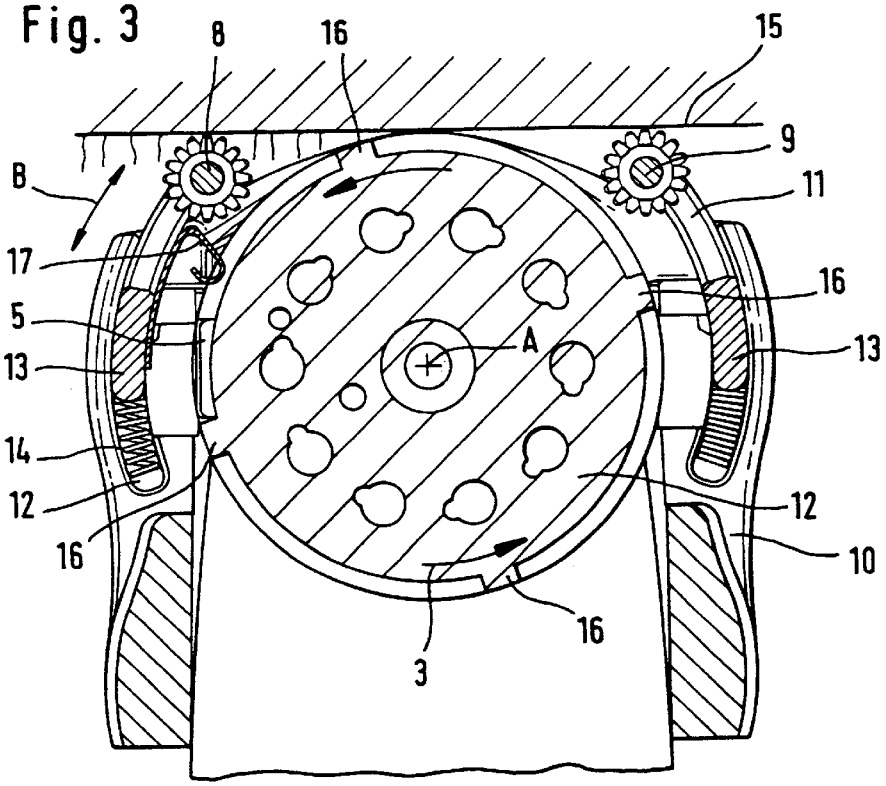
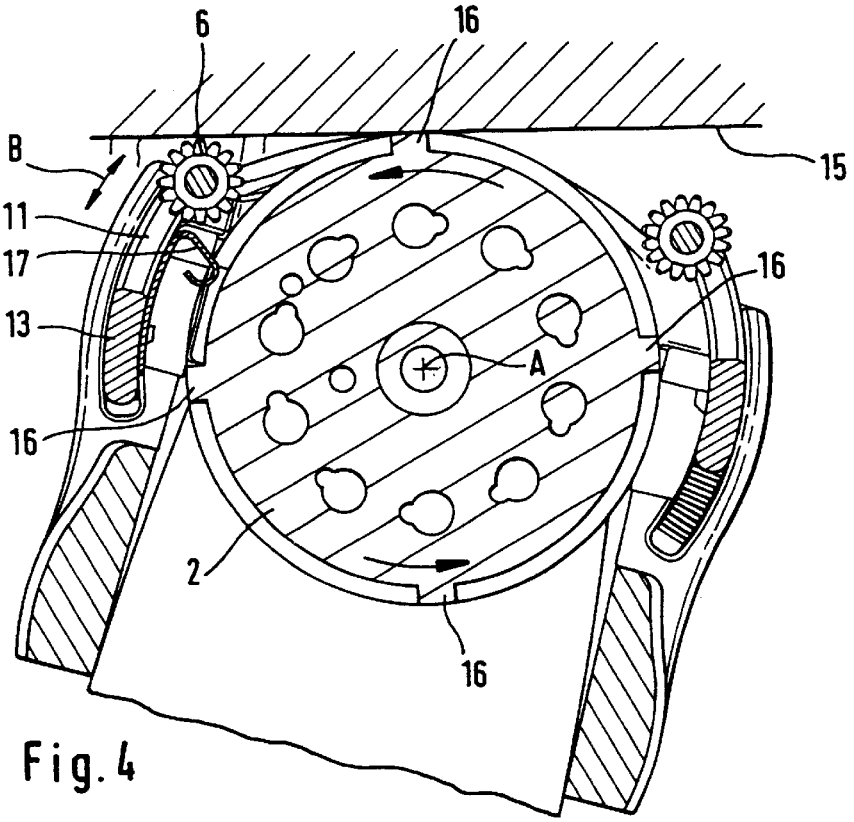
Fig. 4

EPILATION DEVICE

BACKGROUND

This invention relates to an epilator for plucking hairs from the human skin, comprising a housing in which an epilating head driven by drive elements and carrying plucking elements is mounted, provision being made in the area of the epilating head for movably mounted driven elements for the mechanical stimulating striking of the skin by a contact element.

An epilator of this type is known from WO 97/19613, for example. This document shows, integrated in an epilator, a massage arm with elastic projections of a soft material facing the skin, which is guided by two guide rods and, driven by an eccentric cam, is moved back and forth in a direction parallel to the longitudinal axis of the housing. The eccentric cam acts upon the massage arm via a helical spring and causes a moment in alternate directions to be exerted on the massage arm. The magnitude of the force transmitted from the eccentric cam onto the massage arm is defined by the clamping conditions and the geometrical dimensions, and hence the stimulation of the user's skin by the massage arm is always constant. Furthermore, there is a risk that the rectilinear movement of the massage arm in conjunction with the arched outer contour of the housing will pinch the user's skin.

From EP A 760 219 there is also known a stimulation device for the user's skin which is integrated in an epilator to reduce pain. The stimulation device disclosed in this specification comprises a U-shaped yoke pivot-mounted on the housing and driven to oscillate directly by cams arranged on the epilating cylinder when said cylinder rotates. In this arrangement both the stroke and the frequency of the stimulation device are constant, hence the intensity of the skin stimulation is of a fixed, predetermined magnitude with this appliance, too.

A further disadvantage shared by the two known epilators is their special, elaborate drive mechanism for the driven skin stimulation device.

It is known that the stimulation devices of the epilators serve to reduce the user's subjective sense of pain when plucking body hairs. This is achieved in that an additional irritation, which is less intense or physiologically less disagreeable than the pain of plucking, is superimposed on the pain caused by plucking the hairs. Experience has shown that the irritation needing to be superimposed for optimal pain reduction depends to an extreme degree on the respective user's individual characteristics and varying sensitivity. This is not taken into consideration by the known epilators, and consequently the pain reduction achieved by these appliances is insufficient for many users.

SUMMARY

It is therefore an object of the present invention to provide an epilator of the prior-art type that enables, with a simple design and in economical manner, an optimal reduction of pain for different users with an individual sense of pain.

This object is accomplished in accordance with the invention in that the elements for the mechanical stimulating striking of the skin are constructed in such a way that the intensity of the striking can be varied by the user.

An alternative solution to accomplishing this object is achieved if these elements include at least one resilient component biasing the contact element elastically in the direction of the skin, and if said elements are driven by coupling to the epilating head. This solution takes account to a high degree of the aspect of particularly low manufacturing cost and extremely little constructional effort because hardly any additional components are required for driving the skin stimulation device.

Particularly advantageous is an embodiment of the invention in which the intensity of the striking is variable in dependence upon the angle at which the epilator is placed against the skin, because this enables the user of the epilator to adapt, without interrupting the epilating process, the stimulation effect to his individual needs by the simplest operation and without making any manual settings. This is also possible with an embodiment of the invention in which the intensity of the striking is variable in dependence upon the contact pressure between the epilator and the skin.

For an effective and clearly discernible reduction of pain during the epilating process it is particularly advantageous if the striking of the skin occurs in pulsed fashion. This is accomplishable in simple manner and with little effort if the elements for the mechanical stimulating striking of the skin include at least one elastically biased contact element. Ideally, this contact element is elastically biased in the direction of the skin.

Pins or cylinders, particularly spiked or gearwheel cylinders that roll off the skin, have proven to be particularly suitable contact elements.

If the contact element is guided in such a way that its path of motion defines an arc extending concentrically to the epilating head, on the one hand this will enable a particularly sensitive control of the intensity with which the skin is struck, and on the other hand it will ensure, as a result of the constant distance between the epilating head and the skin stimulation device, that the skin cannot be pinched between the contact element and the epilating head.

Pain can be reduced practically completely by an embodiment of the invention in which provision is made for at least one further, non-driven skin stimulation element in addition to the driven elements for the stimulating striking of the skin. The practical implementation of such a structural concept could be such that, for example, prior to the plucking process the section of skin to be epilated is struck by one or several driven contact elements in order to effect a physiologically less disagreeable irritation of high intensity, while after the plucking this particular section of skin is struck by one or several non-driven contact elements that impart(s) an irritation of appreciably less intensity into the skin.

Factors contributing to the simple design of the epilator of the invention are in particular that the elements for the mechanical stimulating striking of the skin are actuated by the drive elements of the epilating head, i.e., not by a separate drive of their own, in which context it is particularly favorable in drive terms for these elements to be directly actuated by the epilating head. Pulsed striking of the skin is decisive for an optimal reduction of pain, hence a preferred embodiment of the invention provides for actuation of the elements for the mechanical stimulating striking of the skin by means of elastically deformable transmission elements. This enables, in particularly simple manner, a sudden release of striking energy after a deformation of the transmission element has exceeded a predefined value.

A further embodiment of the invention, which is also regarded simultaneously as a separable invention, provides for the elements for the stimulating striking of the skin to be provided in an attachment comprising a base body for attaching to the housing and elements movably mounted inside the base body for the stimulating striking of the skin, said elements being equipped with coupling elements for coupling to the drive elements. This solution, which is also an invention in its own right, affords the possibility of using the elements for pain reduction as accessory parts that the user of the epilator can employ according to requirements. In this way it is also possible to retrofit already existing epilators with a pain reduction device without the need for a particularly elaborate conversion with costly changes to the epilator. The embodiment in which the elements for mechanical stimulating striking of the skin are directly actuated by the epilating head is particularly suitable for configuring the pain reduction device as a retrofittable accessory.

The base body of the attachment is mountable on the housing by positive or, alternatively, frictional engagement therewith; an embodiment in which the base body is connectable to the housing by means of a releasable detent is particularly favorable, however, in terms of precision fit and stability.

Further advantageous features and the function of the present invention will be explained in the following with reference to an embodiment. In this context, all features described or depicted, whether individually or in any combination, constitute the object of this invention irrespective of their summary in the claims or the cross references of the latter. In the drawings.

BRIEF DESCRIPTION OF THE DRAWINGS

FIG. 3 and FIG. 4 are sectional views of the epilator, showing it applied against the skin surface at two different angles;

The same reference characters are employed for corresponding parts in all Figures in the drawing and in the following description.

DETAILED DESCRIPTION

Figure 1:
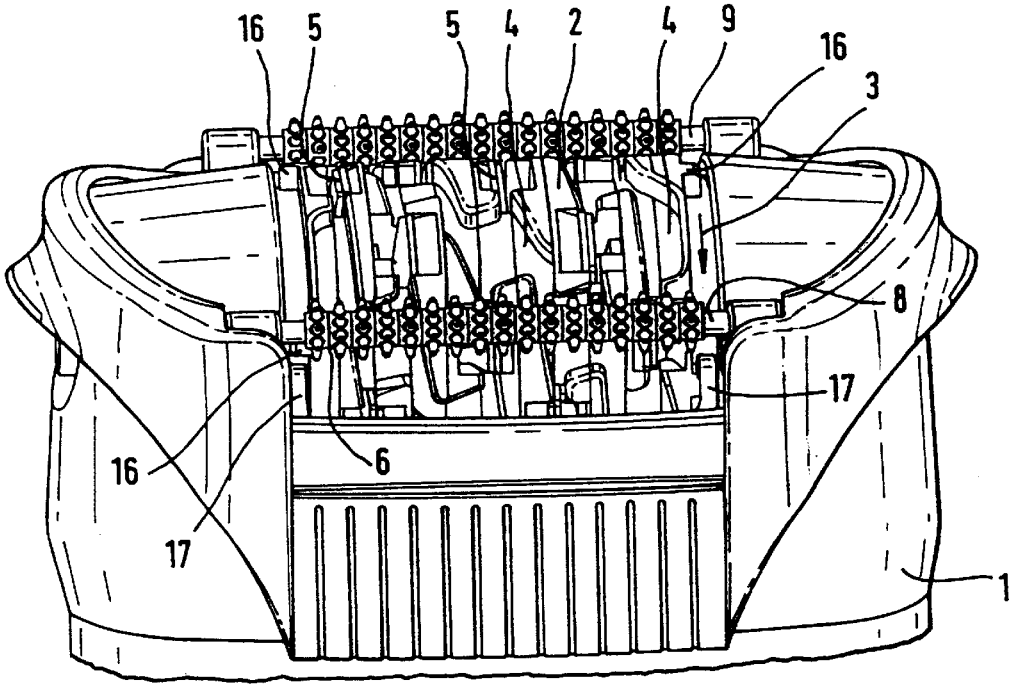
FIG. 1 is a perspective view of the epilator constructed in accordance with the present invention.

The epilator shown in FIG. 1 has a housing 1, shown only in part, in which an epilating head 2 is rotatably mounted. In the part not shown, which is also gripped and held in the user's hand, the housing 1 also accommodates an electric motor, also not shown, and related torque transmission elements, meaning in particular gears, for rotary driving of the epilating head 2. The epilating head according to the embodiment is constructed as a rotary cylinder, such as is known from WO 98/05234. The disclosure content of this international patent application shall be deemed to be incorporated herein by express reference. The epilating head 2 is driven in such a way that its sense of rotation corresponds to the direction of the arrow 3. This is also the direction in which the epilator is guided over the skin to pluck hairs. The epilating head 2 is equipped with several threader grooves 4 extending essentially in circumferential direction, which operate to feed the hairs to be plucked to the clamping elements 5.

The clamping elements 5 are actuated by pins, not shown in the drawings, extending longitudinally in the epilating head 2 and acted upon by cams arranged to the side of the epilating head 2. These cams, also not shown in the drawings, are arranged so that the actual plucking zone of the epilating head is formed by approximately a quarter of the circumferential surface roughly corresponding to the visible area as seen looking down upon FIG. 1. In this plucking zone the tweezers-like clamping elements 5, which reach this plucking zone in open position, are gradually closed and, after being rotated further through a certain angle of rotation, are opened again in order to expel the hair that was intercepted during closing and plucked out during such further rotation.

Before the skin comes into contact with the epilating head for plucking the hairs it is subjected to mechanical stimulation by a first spiked cylinder 6 that rolls off it. As the result of the irritation imparted by the first spiked cylinder 6, the pain caused by the subsequent plucking of the hairs is less intensely felt. To increase the mechanical irritation effected by the first spiked cylinder 6 which extends parallel to the longitudinal axis of the epilating head, said cylinder is driven to oscillate in a direction essentially perpendicular to the skin surface, as will be explained below. A second spiked cylinder 7, whose function is to tauten the skin in the epilating area so that the hairs are gripped better by the clamping elements, extends likewise parallel to the longitudinal axis of the epilating head on its other side. The spiked cylinders 6 and 7 are made of individual rings set in a row on a common spindle 8 and 9, respectively, the rings being able to rotate independently of each other. Each single ring is equipped with eight conical spikes that taper outwards and are spaced uniformly apart on the circumference.

Figure 2:
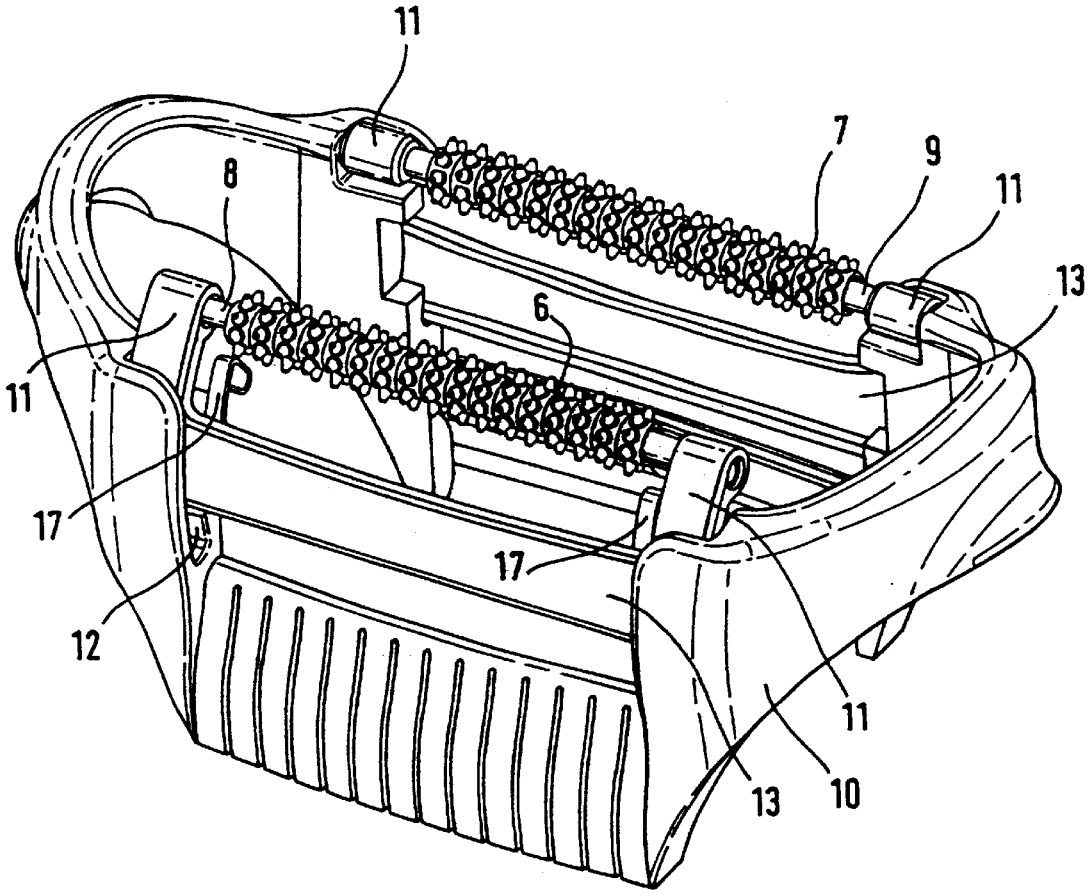
FIG. 2 is a perspective view of an attachment in condition as removed from the epilator.
Figure 5:
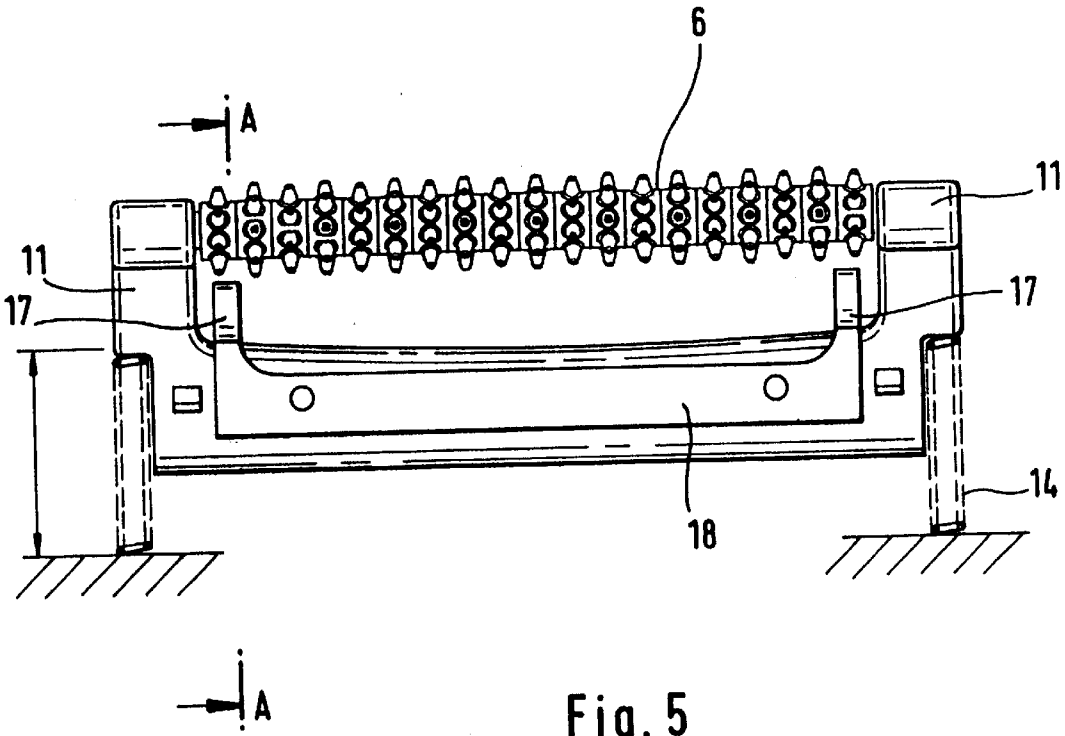
FIG. 5 is a view of a contact element.

FIG. 2 shows, as a separately presented component, the device for reducing pain, which is constructed as an attachment adapted to be fitted to the housing 1. This attachment comprises a base body 10 whose inner contour is shaped to conform to the outer contour of the housing 1 of the epilator. The base body is integrally made of one piece and, as a result of its conical inner contour, is connectable to the epilator by frictional engagement therewith simply by pressing it down onto the housing 1. The base body 10 carries the two spiked cylinders 6 and 7 whose respective spindles 8 and 9 have their end sections carried in arms 11 that are displaceably guided in a cavity 12 of the base body 10. For reasons of stability the two arms 11, each carrying a spindle 8 and 9, respectively, are integrally connected at their ends remote from the spindles 8 and 9 with a bracket 13.

As becomes apparent from FIG. 3, the cavity 12 in the base body 10 defines a curved path shaped in an arcuate configuration. The circular arc profiles of the two cavities 12 are concentric to the axis of rotation A of the epilating head.

Seated between the bottom of the cavity 12 and each arm 11 is a compression spring biasing the arms 11 and hence also the spiked cylinders 6 and 7 in the direction of the skin 15 that is to be epilated. This ensures that the spiked cylinders are always pressed against the surface of the skin 15 that is to be epilated, even at different angles at which the housing 1 of the epilator is positioned against the skin.

While the spiked cylinder 7 engages and rolls off the skin with only the force determined by the compression spring 14, the spiked cylinder 6 is driven to oscillate in addition in the direction of the arrow B so that a vibration is superimposed on the mechanical irritation caused by the spikes of the spiked cylinder. For this purpose several—in this case four—rib-shaped followers 16 are uniformly spaced on the circumference in both end portions of the epilating head 2, which followers cooperate with two coupling elements constructed as leaf springs 17, which are fastened to the bracket 13 or the arm 11. The two leaf springs 17 are interconnected on their side facing away from the spiked cylinder 6 by a strip 18 made integrally therewith. The end of the leaf spring 17 on the side close to the spiked cylinder 6 is bent in hook shape inwards, i.e., in the direction of the epilating head. An end section of the leaf spring extending in U-shape thus engages within the recessed area between two adjacent followers 16 on the circumference of the epilating head 2, hence lying in the orbit of the followers 16.

Figure 6:
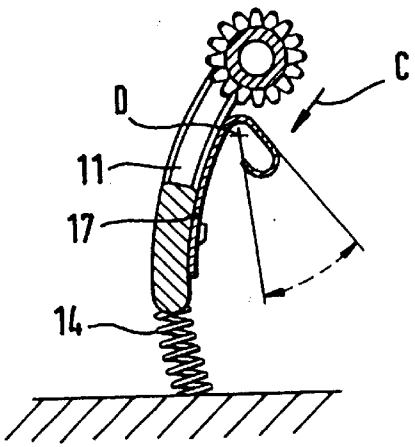
FIG. 6 is a sectional view taken along the line A—A of FIG. 5.

As soon as the follower 16 acts upon the leaf spring 17, as indicated in FIG. 6 by the arrow C, the two arms 11 are urged downward in arc shape within the cavity 12, and the compression spring 14 is compressed. As the result of the progressive characteristic of the compression spring 14, the reaction force acting between the follower 16 and the leaf spring 17 increases until, from a certain threshold value defined by the spring constants of the compression spring 14 and the leaf spring 17, the hook-shaped portion of the leaf spring 17 is swiveled downward about the fulcrum D. Immediately after this swiveling movement the leaf springs 17 snap over the corresponding followers 16 so that the arms 11 and hence the spiked cylinder 6 suddenly spring upwards, driven by the biasing force of the compression spring 14. This upward movement is limited, of course, by a stop acting between the arms 11 and the base body 10. After having snapped over the follower 16, the hook-shaped end of the leaf spring 17 swivels back in counterclockwise direction about the fulcrum D into its initial position, and the follower 16 starts a new cycle of action.

If the angle at which the epilator is placed against the surface of the skin 15 is now changed, as shown in FIG. 4, the higher contact pressure between the skin 15 and the spiked cylinder 6 will urge the arms 11 into the cavity 12 against the force of the compression springs 14. The biasing force of the springs 14 then increases in proportion to the lowering of the arms 11 relative to the position shown in FIG. 3. As the result of this higher biasing force the hook-shaped end portion of the leaf spring 17 now snaps, after a shorter length of displacement caused by the follower 16 and after swiveling about the fulcrum D, over the follower 16 so that the oscillation is effected with a reduced stroke.

In this way it is possible, by suitable infinite variation of the angle of application of the epilator relative to the skin, for the user to set the balance between (constant) contact pressure from the spiked cylinder 6 and intensity of vibration that is most agreeable for him individually. As soon as the user increases the contact pressure between the spiked cylinder and the skin, the intensity of vibration decreases and vice versa. The reduced stroke of the spiked cylinder 6 is represented in FIG. 4 by the smaller double arrow B compared to FIG. 3.

In a practical embodiment of the invention the stroke B of the oscillation of the spiked cylinder 6 can be adjusted between 0.1 and 0.7 mm. The angle of application between the skin 15 and the epilator is changed in the process by +/− 15°, approximately. This is also the plucking range in which the clamping elements 5 operate optimally.

Configuration of the pain reducing device as an attachment with direct drive via the epilating cylinder clearly represents a particularly favorable embodiment of the invention that can also be used as a retrofittable part. Nevertheless, in other embodiments of the invention not presented in the drawings provision is made for the spiked cylinder 6 to be actuated by a separate drive or by an additional power take-off from the drive of the epilating head 2 in the form of a crank or cam control integrated in the housing 1.

Figure 7:
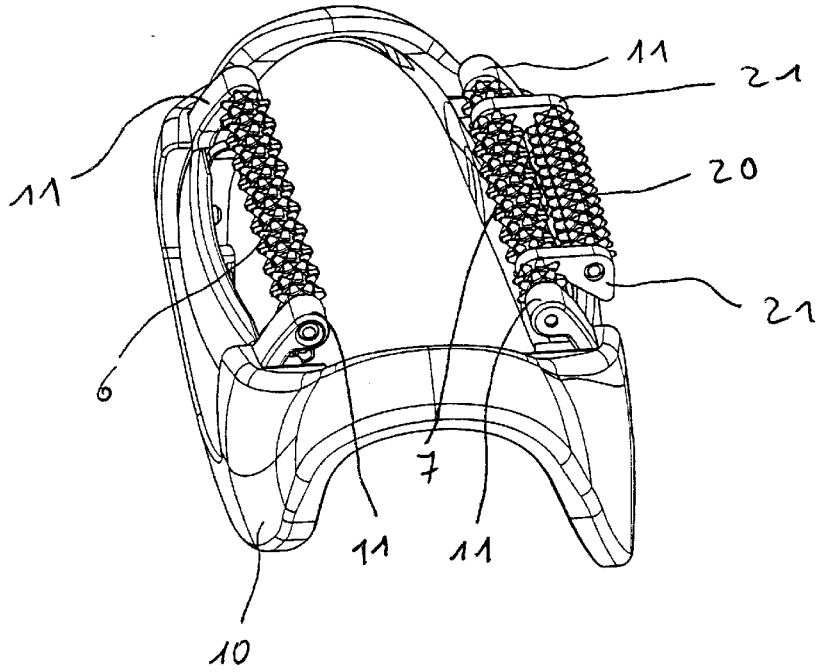
FIG. 7 is a view of a further embodiment of an attachment.
Figure 8:
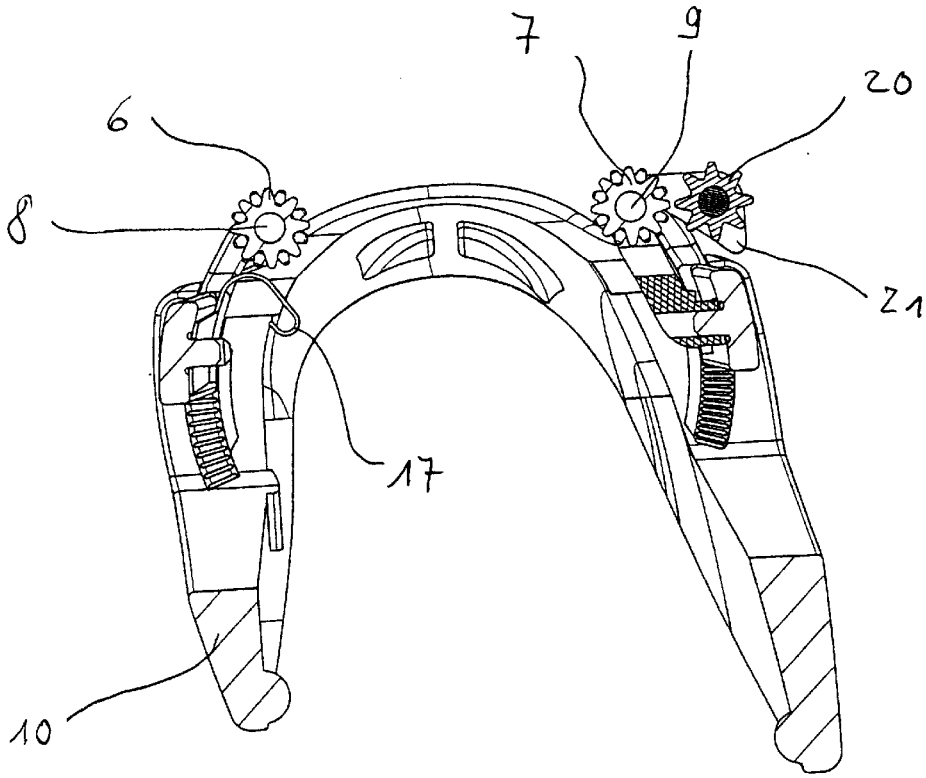
FIG. 8 is a sectional view of the attachment of FIG. 7.

FIG. 7 shows a perspective view of a further embodiment of a device for reducing pain that is constructed as an attachment for mounting on the housing 1. A section through such an attachment is shown in FIG. 8 in order to explain in more detail. Like the attachment of FIG. 2, this attachment also has a base body 10 in which arms 11 carrying spiked cylinders are displaceably mounted and elastically biased in the direction of the skin to be epilated. As with the previously described attachment, the spiked cylinder 6 shown here on the left can be driven via the leaf spring 17 which cooperates with the followers 16 on the epilating head. Mounted on the spindle 9 of the opposing spiked cylinder 7 is a support plate 21, which for its part carries a further spiked cylinder 20. Since—as was previously explained—the spiked cylinders are comprised of individual rings arranged in a row, the support plates 21 replace two spiked cylinder rings otherwise provided at this location. Through the coupling of the spiked cylinder 20 to the spindle 9 it is displaceably mounted and elastically biased in the base body 10 jointly with the spiked cylinder 7. Furthermore, the spiked cylinder 20, which is constructed likewise of individual rings, is also pivot-mounted relative to the spiked cylinder 7 on account of the elasticity of the support plates 21.

The additional spiked cylinder 20 enables even better skin stimulation, yet the entire epilator is still simple and convenient to handle.

It is expressly noted at this point that the support plate 21 and the spiked cylinder 20 can also be coupled in similar manner to the spindle 8 carrying the spiked cylinder 6. This then provides two driven spiked cylinders 6 and 20, with the spiked cylinder 20 being also pivotal in relation to the spiked cylinder 6. This embodiment with two driven spiked cylinders, which is not shown, enables a particularly intensive stimulation of the skin prior to the actual hair plucking operation, while the shown embodiment effects an intensive stimulation of the skin subsequent to the epilating process. A particularly high masking of the pain and relaxation of the skin after the epilating process is achieved when both the driven and the non-driven skin stimulating devices each have two contact elements, particularly spiked cylinders. The number of driven and non-driven contact elements and the order of their arrangement on the epilator can be freely selected to suit the required stimulation effect.

Being able to vary the position of the spiked cylinders 6, 7, 20 relative to the base body 10 as well as relative to each other, i.e., they can be lowered and swiveled relative to each other, permits optimal adaptation to the contour of the skin that is to be epilated, particularly in areas of bones or joints lying proximate the skin.

What is claimed is:

1. An epilator for plucking hairs from human skin, comprising:

a housing;

drive elements;

an epilating head mounted in the housing and driven by the drive elements, said epilating head carrying plucking elements; and movably mounted driven elements near the epilating head and at least one contact element attached thereto for mechanical stimulating striking of a user's skin by said at least one contact elements, said driven elements being mounted for reciprocating movement with respect to said epilating head, wherein said driven elements are constructed in such a way that the extent of travel of said driven elements with respect to said epilating head can be varied by the user.

2. The epilator as claimed in claim 1, wherein the extent of travel of said driven elements is variable in dependence upon an angle at which the epilator is placed against the skin.

3. The epilator as claimed in claim 1, wherein the intensity of the striking is variable in dependence upon a contact pressure between the epilator and the skin.

4. The epilator as claimed in claim 1, wherein said driven elements for the mechanical stimulating striking of the skin include at least one elastically biased contact element.

5. The epilator as claimed in claim 4, wherein said contact element is elastically biased in the direction toward the skin.

6. The epilator as claimed in claim 1, wherein said driven elements for the mechanical stimulating striking of the skin are actuated by the drive elements of the epilating head.

7. The epilator as claimed in claim 1, wherein said driven elements for the mechanical stimulating striking of the skin are actuated directly by the epilating head.

8. An epilator for plucking hairs from human skin, comprising:

a housing;

drive elements;

an epilating head mounted in the housing and driven by the drive elements and, said epilating head carrying plucking elements; and movably mounted driven elements near the epilating head, at least one contact element attached thereto, for mechanical stimulating striking of a user's skin by said at least one contact element, wherein said driven elements are slidably mounted for reciprocating movement with respect to said housing and include at least one resilient component biasing the contact element elastically in the direction toward the user's skin, and said driven elements are driven by coupling to the epilating head.

9. The epilator as claimed in claim 8, wherein said contact element is formed by at least one pin.

10. The epilator as claimed in claim 8, wherein said contact element is formed by at least one rotatably mounted cylinder.

11. The epilator as claimed in claim 8, wherein said contact element is formed by at least one spiked or gear-wheel cylinder.

12. The epilator as claimed in claim 8, wherein the striking of the skin takes place in pulsed fashion.

13. The epilator as claimed in claim 8, wherein said contact element is guided such that its path of motion defines an arc extending concentrically to the epilating head.

14. The epilator as claimed in claim 8, further comprising at least one further, non-driven skin stimulation element in addition to the driven elements for the stimulating striking of the skin.

15. The epilator as claimed in claim 8, wherein the driven elements for the mechanical stimulating striking of the skin are actuated by elastically deformable transmission elements.

16. The epilator as claimed in claim 8, further comprising an attachment comprising a base body for attaching to the housing, wherein the driven elements are movably mounted inside the base body for the stimulating striking of the skin, said driven elements being equipped with coupling elements for coupling to the drive elements.

17. The epilator as claimed in claim 16, wherein the base body is connectable to the housing by positive engagement therewith.

18. The epilator as claimed in claim 16, wherein the base body is connectable to the housing by frictional engagement therewith.

19. The epilator as claimed in claim 16, wherein the base body is connectable to the housing by means of a releasable detent.

20. The epilator as claimed in claim 15, wherein the elastically deformable transmission elements are leaf springs.

21. The epilator as claimed in claim 16, wherein the coupling elements are leaf springs.

* * * * *